United States Patent [19]

Imamura

[11] 3,930,387

[45] Jan. 6, 1976

[54] KNITTED FABRIC WITH A LAID IN METAL CHAIN

[75] Inventor: Koji Imamura, Tokyo, Japan

[73] Assignees: Tokyo Sun Co., Ltd.; The Kanon Co., Inc., both of Tokyo, Japan

[22] Filed: Oct. 15, 1973

[21] Appl. No.: 406,341

[30] Foreign Application Priority Data

Oct. 17, 1972 Japan ..... 47-119997

[52] U.S. Cl. ..... 66/190; 66/200; 2/90

[51] Int. Cl.[2] ..... D04B 7/14; A41D 1/04

[58] Field of Search ..... 66/190, 202, 171, 169, 66/170, 172.8, 200, 197, 198, 61, 69, 9 R; 160/349 R, 349 D; 2/90

[56] References Cited

UNITED STATES PATENTS

| | | | |
|---|---|---|---|
| 1,247,404 | 11/1917 | Hyde | 2/90 X |
| 1,598,582 | 8/1926 | Chipman | 66/172 R |
| 1,672,640 | 1/1927 | Doederlein | 66/169 |
| 1,856,053 | 4/1932 | Graenz | 66/198 |
| 1,915,792 | 4/1932 | Kugelman | 66/172 R |
| 2,159,425 | 5/1939 | Davies | 160/349 |
| 2,329,994 | 9/1943 | Kingman | 66/170 |
| 2,365,268 | 12/1944 | Herter | 66/170 |
| 2,432,898 | 12/1947 | Imbriani | 66/172 R |
| 2,440,393 | 4/1948 | Clark | 66/190 |
| 2,492,097 | 12/1949 | Katz | 2/90 |
| 2,653,463 | 9/1953 | Crimmins | 66/190 |
| 3,259,151 | 7/1966 | Schmitz | 160/349 |
| 3,347,297 | 10/1967 | Garland | 66/170 |

*Primary Examiner*—W. C. Reynolds
*Assistant Examiner*—A. M. Falik
*Attorney, Agent, or Firm*—Cushman, Darby & Cushman

[57] ABSTRACT

Knitted material having chains interlaid between double-knitted loops and knitted in any conventional fashion to form a pattern. Preferably the chainsupporting loops are knitted by rib stitches with wales formed in a series of 1 × 1 ribs alternatively constituting the front and back stitches. The courses may include plain stitches with the two loops of the rib stitches disposed at the junction between the rib stitches and the plain stitches being linked to a loop of the plain stitches on the adjacent course.

3 Claims, 14 Drawing Figures

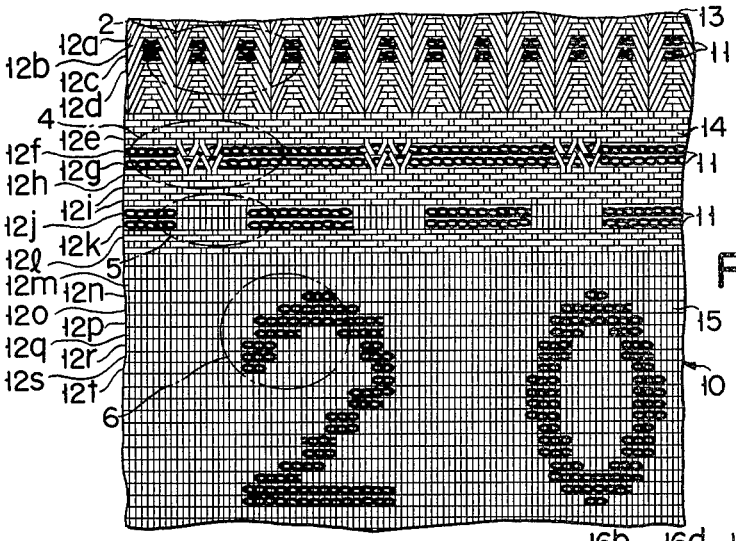
FIG. 1
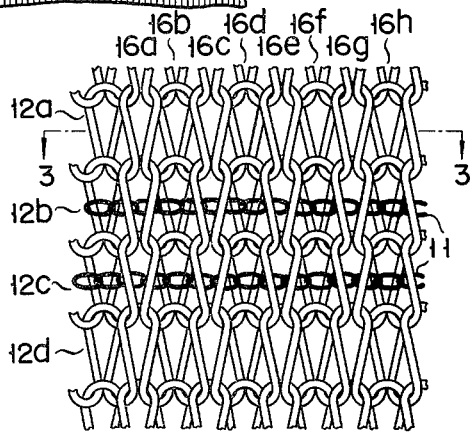
FIG. 2
FIG. 3
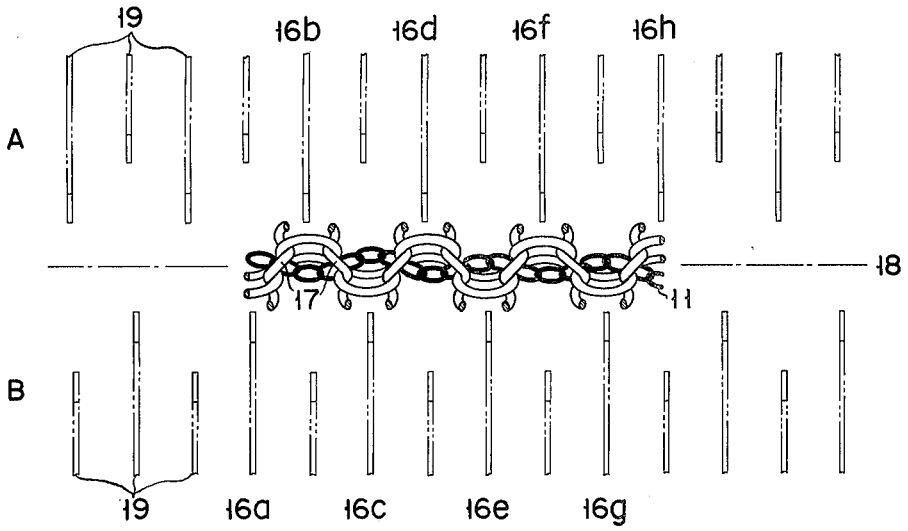

FIG. 7
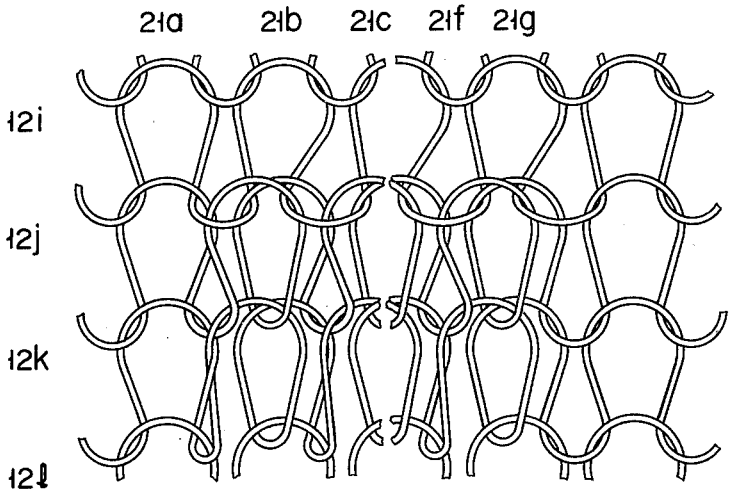
FIG. 8A
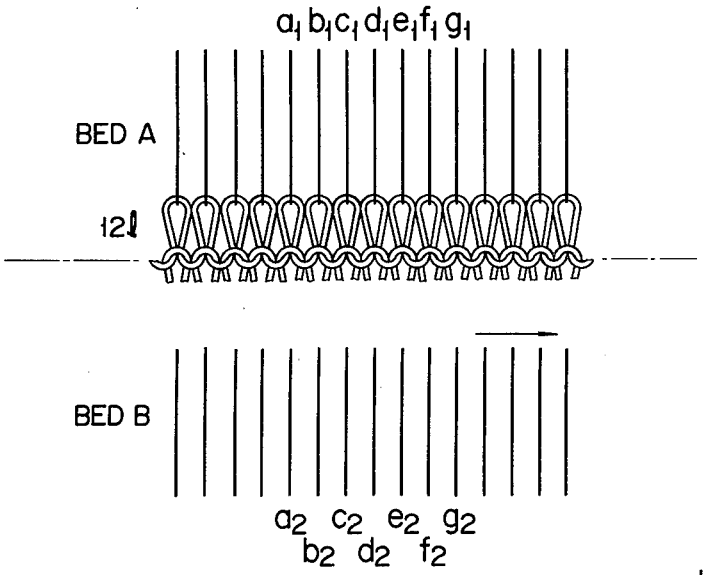
FIG. 8B
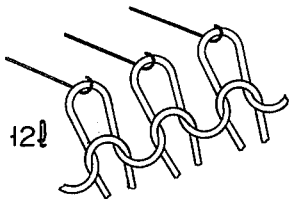
FIG. 9B
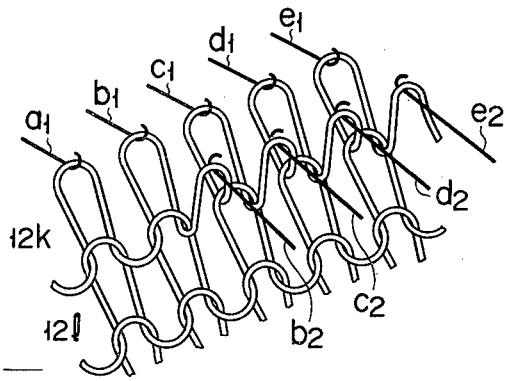
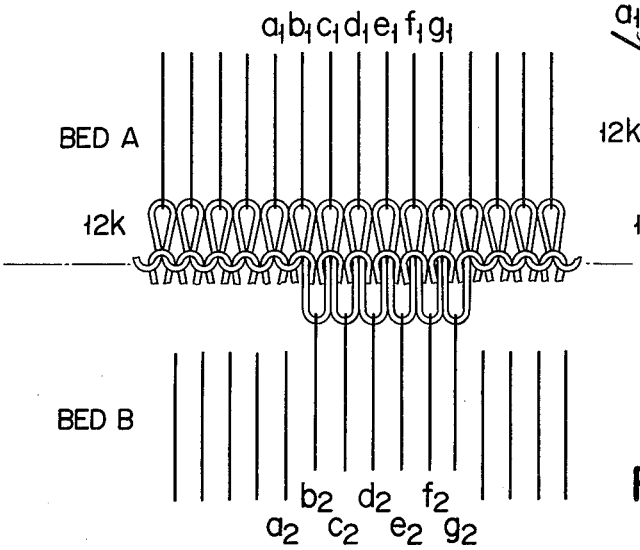
FIG. 9A FIG. 10A
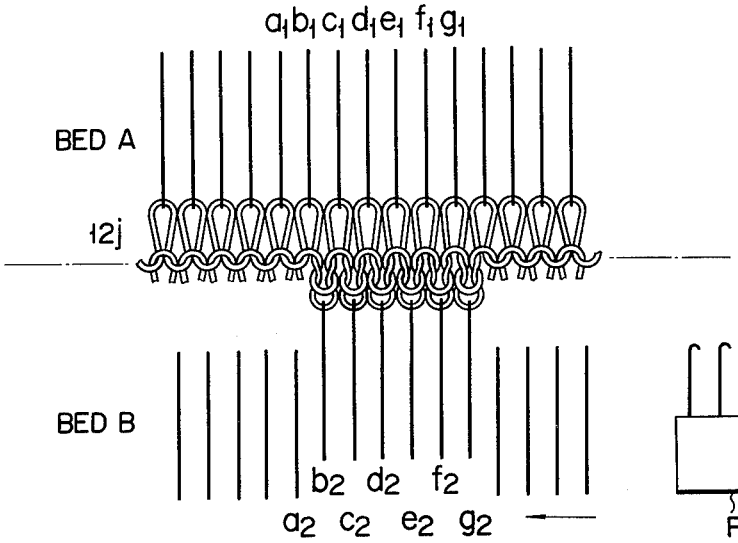
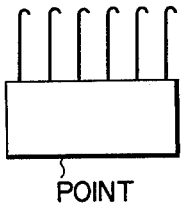
FIG. 11
FIG. 10B
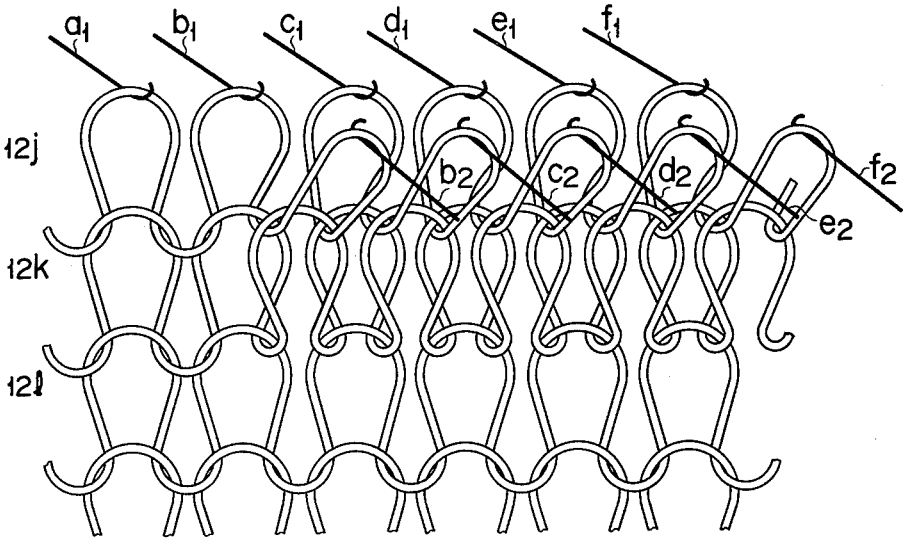

KNITTED FABRIC WITH A LAID IN METAL CHAIN

This invention relates to knitted material used with clothing or for indoor decorative purposes.

As is well known, the general field of clothing is ready for not only a design or arrangement to be applied to texture, but also a new type of clothing material itself, for example, knitted material. Already known are knitted material bearing patterns obtained by changing the material or color of particular yarns or knitting them in a different manner from those constituting the base texture, or other kinds of clothing material such as those embroidered or creweled. However, all these types of clothing material have lost a visual appeal.

Further, conventional knitted material has low strength and durability. Particularly the knitted material forming a sleeve band, neck portion or pocket can be easily damaged or stretched. Moreover, the prior art knitted material has the drawback that during long use it looses its elasticity.

It is accordingly the object of this invention to provide knitted material strong enough to withstand long use and particularly of such type as has not been thought of.

The knitted material of this invention has at least one chain interlaid between adjacent double-knit loops. As used herein, the term "double-knit loops" is defined comprehensively to mean loops constituting knitted material generally referred to as "double knit". Accordingly, the double-knitted loops include those formed of rib stitches and figured stitches obtained by a jacquard knitting machine.

The knitted material of this invention using chains whose application as the component of knitted material has not been thought of provides a unique visual appeal and can display a large variety of patterns according to the manner in which the double-knitted loops and chains are arranged.

The outstanding feature of the knitted material of this invention originates with the properties of chains used, namely, their relatively small extensibility, great strength and prominent flexibility. Therefore, the present knitted material not only maintains mechanical strength or tension, even if it is used for long periods, but also always provides a satisfactory fit to any wearer. Further, the depressions defined by the respective adjacent links of a chain conveniently engage the yarns of the double-knitted loop, enabling the chain to be securely kept in a prescribed position. It is, therefore, unnecessary particularly to sew the chain to the knitted material, for example, with a thread.

For the object of this invention, it is preferred that the chain be made of metal. The metal chain applies a downward-acting tensile force to the knitted material and causes the material to fit the wearer closely, rendering his physical outline more distinguished. Moreover, the adequate weight of the metal chain prevents clothing consisting of knitted material bearing said metal chain from getting out of shape when it is worn.

The double-knitted loops of knitted material can be made into the so-called double rib stitch bearing two-fold loops for each wale. In this case, the metal chain is very firmly supported by said two-fold loops. Moreover, those portions of the metal chain which are held by the two-fold loops are concealed from view. Thus, clear distinction is made between the exposed and hidden portions of the chain, effectively presenting a distinct pattern.

This invention can be more fully understood from the following detailed description when taken in conjunction with the accompanying drawings, in which:

FIG. 1 is a schematic plan view of metal chain-bearing knitted material according to this invention presenting various patterns formed by different knitting processes;

FIG. 2 is an enlarged view of the section surrounded by a circle 2 in FIG. 1;

FIG. 3 is a sectional view on line 3—3 of FIG. 2;

Figure 4:
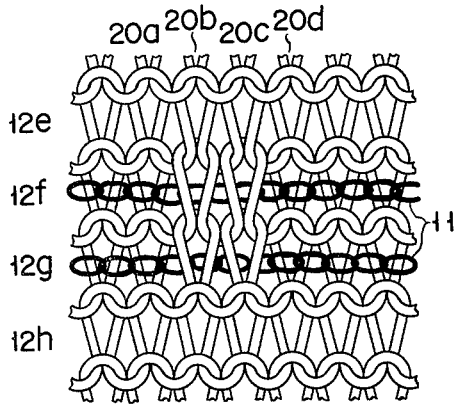
Figure 5:
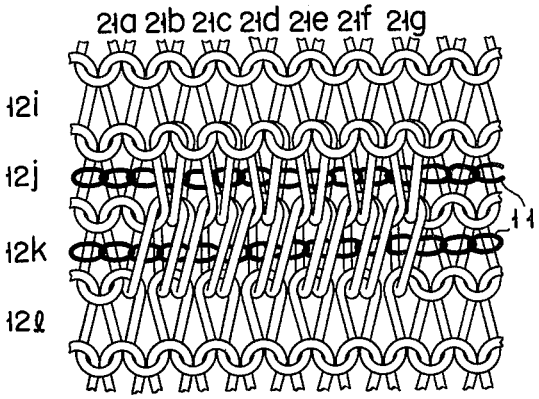
Figure 6:
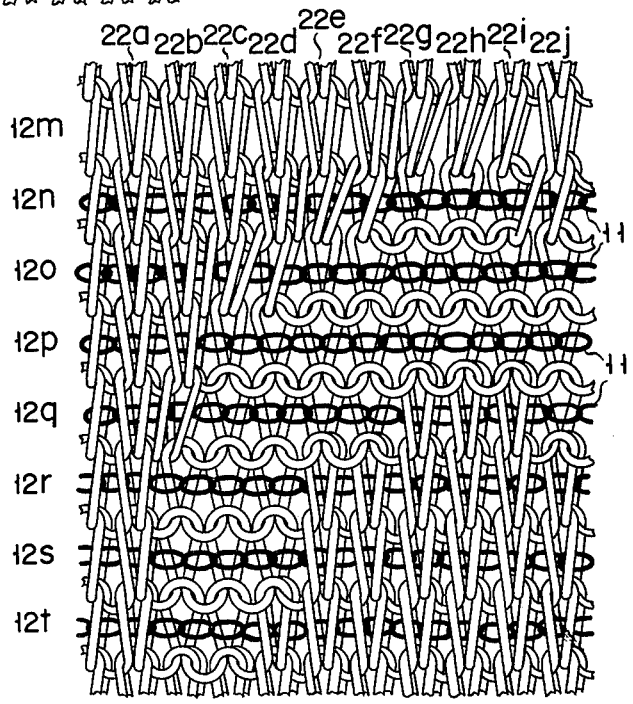

FIGS. 4, 5 and 6 are enlarged views of the sections surrounded by circles 4, 5 and 6 in FIG. 1.

FIG. 7 is an enlarged view of FIG. 5 in which the loops are somewhat deformed and the chains are not shown for clarity;

FIGS. 8A, 9A and 10A are schematic views showing respectively, like FIG. 3, the knitted loops on the course 12*l*, the knitted loops on the course 12*k* and the knitted loops on the course 12*j*, the chains being not shown;

FIGS. 8B, 9B and 10B are enlarged perspective views respectively of the loops shown in FIGS. 8A, 9A and 10A; and FIG. 11 is a schematic view showing a point used for shifting the loops.

The knitted material 10 of FIG. 1 bears metal chains 11 arranged along the courses of woolen yarn loops. For better understanding of this invention, FIG. 1 indicates different processes of knitting the clothing material 10. Namely, the section 13 denotes rib stitches, the section 14 plain stitches and the section 15 the so-called double rib stitches. Though the manner in which the metal chain is exposed to view varies with the knitting process used and the condition and arrangement of the loops holding the metal chain, preferably the metal chain-supporting loops are knitted by rib stitches.

As seen from FIG. 2, the rib-stitched section 13 comprises wales each formed of a series of 1 × 1 ribs alternately constituting the front and back stitches; and courses of yarn loops, for example 12*a*, 12*b*, 12*c* and 12*d*, of which the courses 12*b* and 12*c* are each provided with a metal chain 11 extending along the length. The metal chains are interlaid between front loops constituting wales 16*a*, 16*c*, 16*e* . . . and back loops forming wales 16*b*, 16*d*, 16*f* . . . . When, therefore, the knitted material is observed from the front side, the metal chains 11 appear only on the back loop wales 16*b*, 16*d*, 16*f* . . . , and when the knitted material is looked at from the back side, the metal chains 11 are exposed to view only on the front loop wales 16*a*, 16*c*, 16*e* . . . . Accordingly, the metal chains 11 present the same patterns on both front and back sides of the knitted material.

As is well known, the rib-stitched material has the back loop wales and front loop wales partly superposed on each other. Consequently, the metal chain 11 is interlaid between the front and back loops in the form of zigzags as viewed through the thickness of the knitted material (FIG. 3). The zigzag formation of the metal chain 11 and the meshing allowance of the respective links thereof enable the metal chain 11 to be lengthened or contracted along the length to a relatively large extent.

Both peripheral edges of the metal chain 11 have an undulating outline. Part of looped yarns 17 passes through the depressions defined by the respective adjacent links of the metal chain 11. This prevents the chain 11 from making a large lengthwise displacement through the loop course. It is therefore unnecessary to sew the metal chain 11, for example, with a thread to the knitted material, for example, at points spaced from each other at a prescribed interval. Where occasion demands, the metal chain 11 has only to be fixed at both ends to the knitted material.

With the knitted material of this invention, the interlaying of the metal chain 11 between the front and back loops can be very easily effected by the conventional knitting machine, for example, a flat knitting machine not only mechanically but also simultaneously with the knitting of loops. Referring to FIG. 3, the chain line 18 shows the boundary of both needle beds A and B of a flat knitting machine, and reference numeral 19 denotes knitting needles mounted parallel with each other on the needle beds A and B. As is well known, use of needles 19 on both needle beds A and B provides rib stitching, and application of needles 19 on one of the needle beds A and B effects flat knitting. To knit the material of FIG. 2, it is only required to set needles 19 on both needle beds A and B in an operative position (the position of a projecting needle shown in FIG. 3) in alternate relationship. As seen from FIG. 3, the metal chain 11 is placed on the boundary 18, and then back loops are formed on the upper side of the boundary 18 and front loops are provided on the lower side thereof in a manner to face each other across the metal chain 11. Thus the metal chain 11 is properly interlaid between the front loop wales and back loop wales in zigzags as viewed through the thickness of the knitted material.

The greater part of the knitted material shown in FIG. 4 consists of flat-knitted back loops. Only the wales 20*b* and 20*c* associated with the loop courses 12*f* and 12*g* are formed of front loops or rib stitches. Accordingly, metal chains 11 placed in the loop courses 12*f* and 12*g* are concealed from view at the front loop wales 20*b* and 20*c* and exposed at the other sections of the loop courses 12*f* and 12*g*. The interval between the chain-supporting front loops and the number of front loops at each chain-supporting point can be suitably chosen.

The material of FIG. 4 can be knitted by the same process as shown in FIGS. 2 and 3. Namely, that portion of the knitted material where the metal chain is exposed is formed by causing needles 19 only on the needle bed A to provide back loops by flat knitting, and that portion of the knitted material which supports the metal chain is formed by causing needles 19 only on the needle bed B to knit front loops.

The knitted material of FIG. 5 is mostly formed, as in FIG. 4, of flat-knitted back loops. However, the section of the knitted material of FIG. 5 which supports the metal chains 11 is knitted in a different manner from FIG. 4. In FIG. 5, the metal chains 11 are placed in the loop courses 12*j* and 12*k*, and supported at wales 21*b* to 21*g* by the so-called double rib stitches. Namely, the metal chain-supporting section of the loop course 12*j* or 12*k* includes two-fold loops as against a single loop used in the loop course 12*j* or 12*l*. In this case, the front and back two-fold loops jointly constitute rib stitches. As more clearly shown in FIG. 7, each pair of front and back loops corresponds to one of the purl loops of the plain stiches on the course 12*i* or 12*l*. Thus, twice as many loops of the rib stitches as loops of the plain stitches on the courses 12*i* or 12*l* are arranged on the course 12*j* or 12*k*, so that the loops of the rib stitches are more densely arranged than those of the plain stitches. A knitted fabric having rib and plain stitches united in such a manner has been employed for many years in the textile industry. In this knitted material (FIG. 5), the supporting loops on the courses 12*j* and 12*k* for the wales 21*b*–21*g* are arranged close to each other, thereby securely holding the metal chain. Since the portion of the metal chain thus supported is not exposed to view either on the back or on the front side of the knitted material, the metal chain as a whole intermittently appears on the surface of the knitted material to provide a very effective visual appeal. The knitting of the metal chain-supporting twofold loops can be carried out simply by simultaneously operating all the needles fitted to both needle beds A and B of FIG. 3. The steps for knitting the above-mentioned fabric can be described with reference to FIGS. 8A–10B, and are obvious from conventional knitting machines. The loops on the course 12*l* constitute normal plain stitches and are knitted by the needles only on the bed A. At this stage the needles on the bed A are aligned with the respective needles on the bed B. When the loops on the course 12*l* have been knitted, the bed B is shifted in the direction of the arrow (FIG. 8A) about half the distance of the space between the adjacent needles thereon. After this has been accomplished, the needles $b_2$–$g_2$ on the bed B are brought into an operative position, while the other needles on the bed *B* remain in an inoperative position. Then the needles $b_2$–$g_2$ automatically form the front loops of the rib stitches on the course 12*k* and the needles on the bed A form the back loops (FIGS. 9A and 9B). Once all the loops have been knitted on the course 12*j* in the same manner as those on the course 12*k* (FIGS. 10A and 10B), the bed B is returned to its initial position to make the needles on the bed B aligned again with those on the bed A. Then, the loops caught by the needles $b_2$–$g_2$ on the bed B are moved onto the needles $b_1$–$g_1$ on the bed A by means of a point (FIG. 11), and the needles $b_1$–$g_1$ each hold a pair of front and back loops. Thereafter, the needles $b_2$–$g_2$ on the bed B are brought into an inoperative position and the knitting machine is then operated to cause the needles on the bed A to form the loops of the plain stitches on the course 12*i*.

The portion of the knitted material 15 shown in FIG. 6 is a modification from that of FIG. 5 in which the metal chain portion appearing on the fabric surface forms a pattern. As mentioned above, in FIG. 5 the portion of the metal chain supported by the double rib stitches does not substantially appear on the surface of the knitted material. Where, therefore, the loops constituting the particular sections of the knitted material are formed by flat knitting and the loops constituting the remaining sections are knitted by double rib stitches, then the metal chain shows any desired pattern by being exposed to view on said particular sections consisting of flat knitted loops. The exposed portion of the metal chain shown in FIG. 6 is an enlarged view of that part of a numeral "2" which is surrounded with a circle 6 in FIG. 1. To provide such a numerical pattern, metal chains 11 are placed in all the loop courses required to delineate a numeral. Plain and rib loops are formed at different portions along each course according to the outline of the numeral being made. To indicate, for example, the abovementioned numeral 2 of FIG. 1, the loops of the wales 22*b* and 22*c* in the loop course 12*t*, those of the wales 22*b*, 22*c* and 22*d* in the loop cource 12*s*, and those of the wales 22*c*, 22*d*, 22*e*, 22*f* and 22*j* in the loop course 12*q* are formed by flat knitting, and the loops of the wales 22*g*, 22*h* and 22*i* in the loop course 12*q* are provided by double rib stitches as illustrated in FIG. 6. According to the embodiment of FIG. 6, all the loops constituting the loop course 12*m* are formed by double rib stitches. Obviously, these loops may permissibly be flat-knitted. The knitted fabric shown in FIG. 6 can be produced in the same manner as described with reference to FIGS. 8A–10A and 8B–10B. For example, when the loops on the course 12*q* are to be knitted, all the needles on the the bed A and some of the needles on the bed B for the wales 22*a*, 22*b* and 22*g*–22*i* are operative, while the other needles on the bed B are held inoperative. When loops are knitted on the course 12*q*, the loops for the wales 22*g*–22*i* are brought into an inoperative position. In this condition, the loops on the courses 12*p* are knitted and then the needles on the bed B for the wales 22*c* and 22*d* are made operative to knit loops on the course 12*o*.

The aforesaid chain 11 incorporated in knitted material was described to consist of metal. However, the chain may by made of such type of synthetic resin as is mechanically strong and has a certain weight. Though, in the foregoing embodiment, a single chain was placed in each loop course, yet it is of course possible to use two or more chains for each loop course according to the thickness of the chain or yarn or the size of the loop.

What is claimed is:

1. A knitted fabric comprising courses formed of a plurality of loops, some of said courses including alternatively arranged front and back loops, and at least one metal chain which extends along the course and is interlaid between said front and back loops, said alternatively arranged front and back loops constituting rib stitches and the other loops constituting plain stitches, the two loops of the rib stitches that are disposed at the junction between the rib stitches and the plain stitches being linked to a loop of the plain stitches on the adjacent course.

2. A knitted fabric according to claim 1, wherein said plain stitches are arranged with the rib stitches to form a predetermined pattern.

3. A knitted fabric comprising courses formed of a plurality of loops, some of said courses including alternatively arranged front and back loops, and at least one metal chain which extends along the course and is interlaid between said front and back loops, said front and back loops constituting 1 × 1 rib stitches.

* * * * *